US007265501B2

(12) United States Patent
Warner et al.

(10) Patent No.: US 7,265,501 B2
(45) Date of Patent: Sep. 4, 2007

(54) MOBILE LIGHT

(75) Inventors: Randy L. Warner, Harrisburg, PA (US); Thomas A. Showalter, Harrisburg, PA (US)

(73) Assignee: Protection Services Inc., Harrisburg, PA (US)

( * ) Notice: Subject to any disclaimer, the term of this patent is extended or adjusted under 35 U.S.C. 154(b) by 40 days.

(21) Appl. No.: 11/077,161

(22) Filed: Mar. 11, 2005

(65) Prior Publication Data

US 2006/0202634 A1 Sep. 14, 2006

(51) Int. Cl.
*G05F 1/00* (2006.01)

(52) U.S. Cl. ..... 315/291; 315/82

(58) Field of Classification Search ..... 315/56, 315/77, 82, 85, 209, 291, 276–277, 224, 315/307–309; 362/487, 507; 307/10.1, 307/10.8

See application file for complete search history.

(56) References Cited

U.S. PATENT DOCUMENTS 5,229,602 A * 7/1993 Juliger ..... 250/222.2
5,514,935 A * 5/1996 Oda et al. ..... 315/82
5,691,696 A * 11/1997 Mazies et al. ..... 340/471
6,056,421 A * 5/2000 Johnson ..... 362/293
6,504,265 B2 * 1/2003 Toda et al. ..... 307/10.8
6,583,570 B1 * 6/2003 Ito et al. ..... 315/82
6,710,545 B2 * 3/2004 Yamaguchi et al. ..... 315/82
7,187,136 B2 * 3/2007 Fiorello ..... 315/224
2002/0093289 A1 * 7/2002 Petrick ..... 315/149
2002/0093741 A1 * 7/2002 Bechtel et al. ..... 359/604
2002/0109468 A1 * 8/2002 Takeda et al. ..... 315/291
2003/0006706 A1 * 1/2003 Yamaguchi et al. ..... 315/82
2003/0052624 A1 * 3/2003 Toyama et al. ..... 315/291
2003/0222588 A1 * 12/2003 Myron et al. ..... 315/159
2004/0090188 A1 * 5/2004 Ishizuka et al. ..... 315/291
2005/0179406 A1 * 8/2005 Harada et al. ..... 315/291
2006/0108940 A1 * 5/2006 Kamoi ..... 315/209 R

OTHER PUBLICATIONS

International Search Report for PCT/US06/09126 dated Aug. 9, 2006.
Written Opinion of the International Searching Authority for PCT/US06/09126 dated Aug. 9, 2006.

* cited by examiner

*Primary Examiner*—Trinh Dinh
*Assistant Examiner*—Tung X Le
(74) *Attorney, Agent, or Firm*—Nixon & Vanderhye P.C.

(57) ABSTRACT

A mobile light is disclosed that produces a high level of illumination without glare using the DC power of a vehicle's battery and charging system. The mobile light uses a high-intensity discharge lamp with a control circuit that initially ignites the lamp using a voltage multiplier circuit and that maintains illumination of the lamp using an FET switching circuit that applies a lower AC voltage to the lamp. The microprocessor also periodically adjusts the power delivered to the lamp to compensate for adverse conditions, such as high temperatures within the work light, or a high or low DC input voltage. The microprocessor also periodically senses the level of illumination provided by the lamp and adjusts the voltage applied to the lamp accordingly.

27 Claims, 3 Drawing Sheets

MOBILE LIGHT

BACKGROUND OF THE INVENTION

The present invention relates to highway construction equipment, and more particularly to a high illumination, non-glare mobile light that operates using the DC power from a vehicle's battery and charging system.

Everyday, roads and bridges are subjected to significant wear and tear due to large amounts of traffic traveling on them. The wear and tear due to traffic, coupled with wear and tear due to exposure to the elements, requires such roads and bridge to be periodically repaired. Because the roads and bridges are used everyday by many people for commuting to work or for conducting other business, typically, any repairs to the roads or bridges must be done during off-peak hours, which are often at night when a minimal number of vehicles travel the roads and bridges.

When repair work on roads and bridges is done at night, there is a need for adequate lighting of the work zone in which the repairs are being performed so that highway workers are capable of seeing the condition of the roads and bridges they are repairing and the work that they are performing to complete the repairs. Typically, the highway construction crews use a number of work lights that provide high illumination of the work zone area.

One of the problems presented by the use of the high illumination lights in a construction work zone is the glare that is produced by the lights. This glare can significantly reduce the vision of motorists approaching the work zone. If the loss of vision produced by the work zone light glare is significant enough, it can result in motorists becoming disoriented because of an inability to see the workers and equipment in the construction zone. The result can be an accident in which the motorist or workers in the work zone are injured.

Another concern that arises with the use of lights to illuminate a work zone is the need to provide a source of power to operate the lights. Typically, because of the large amount of illumination produced by such lights, the power requirements of the lights require the provision of one or more gasoline powered generators to operate the lights. The need to provide generators to operate the lights requires additional cost to obtain and operate the generators and space to accommodate the generators.

BRIEF DESCRIPTION OF THE INVENTION

The present invention is a mobile light, that overcomes the problems associated with current work zone lights by producing a high level of illumination without glare using the DC power of a vehicle's battery and charging system, thereby eliminating the need for an additional power source, such as a gasoline-powered generator. The mobile light of the present invention uses a high-intensity discharge ("HID") lamp with a control circuit that initially ignites the lamp using a voltage multiplier circuit and that maintains the operation of the lamp using a switching circuit that applies a lower AC voltage to the lamp. The voltage multiplier circuit converts the 12V DC voltage from a vehicle up to a 5,000V level, and more typically up to a 3,000-4,000 V level, to ignite the gas in the HID lamp. Once the lamp is ignited, a microprocessor controls the switching of several FET transistors driving a step-up transformer to apply a quasi sine wave AC signal of preferably about 204 V rms to the lamp to continue its illumination. The microprocessor ramps up the frequency at which it switches the FETs so as to effectively produce a constant current consumption by the lamp during its warm-up phase. The microprocessor also periodically adjusts the power delivered to the lamp to compensate for adverse conditions, such as high temperatures surrounding the FETs, or a high or low DC voltage being supplied by the battery and charging system of the vehicle providing the DC voltage for operating the lamp. Finally, the microprocessor also periodically senses the condition of the lamp and adjusts the voltage applied to the lamp accordingly.

The illumination provided by the light of the present invention does not produce glare to motorists approaching the work zone. The interior of the lamp is coated so that, as manufactured, it diffuses light. In addition, a plastic acrylic lens placed over the light is textured and coated internally with a white paint that enhances illumination and diffuses light to eliminate glare.

The mobile light of the present invention also includes a filtered air intake, such that a positive pressure produced by a cooling fan within the unit keeps dust from entering the lens covering the lamp that would reduce the light output by the lamp, while also cooling the internal components of the circuit.

The mobile light of the present invention can also be used for special events or other applications requiring lighting. For example, the mobile light of the present invention can be used for nighttime outdoor events, such as, for example, football games, rallies or camping events where a ready source of light is not available. The mobile light of the present invention can be used in these situations by attaching the light to the 12V battery of any vehicle that would be available at the event. Conversely, if a 12V power source is not available, a 120V AC source could be used with an AC to DC converter to produce a 12V DC power source to power the mobile light of the present invention.

DETAILED DESCRIPTION OF THE INVENTION

Figure 1:
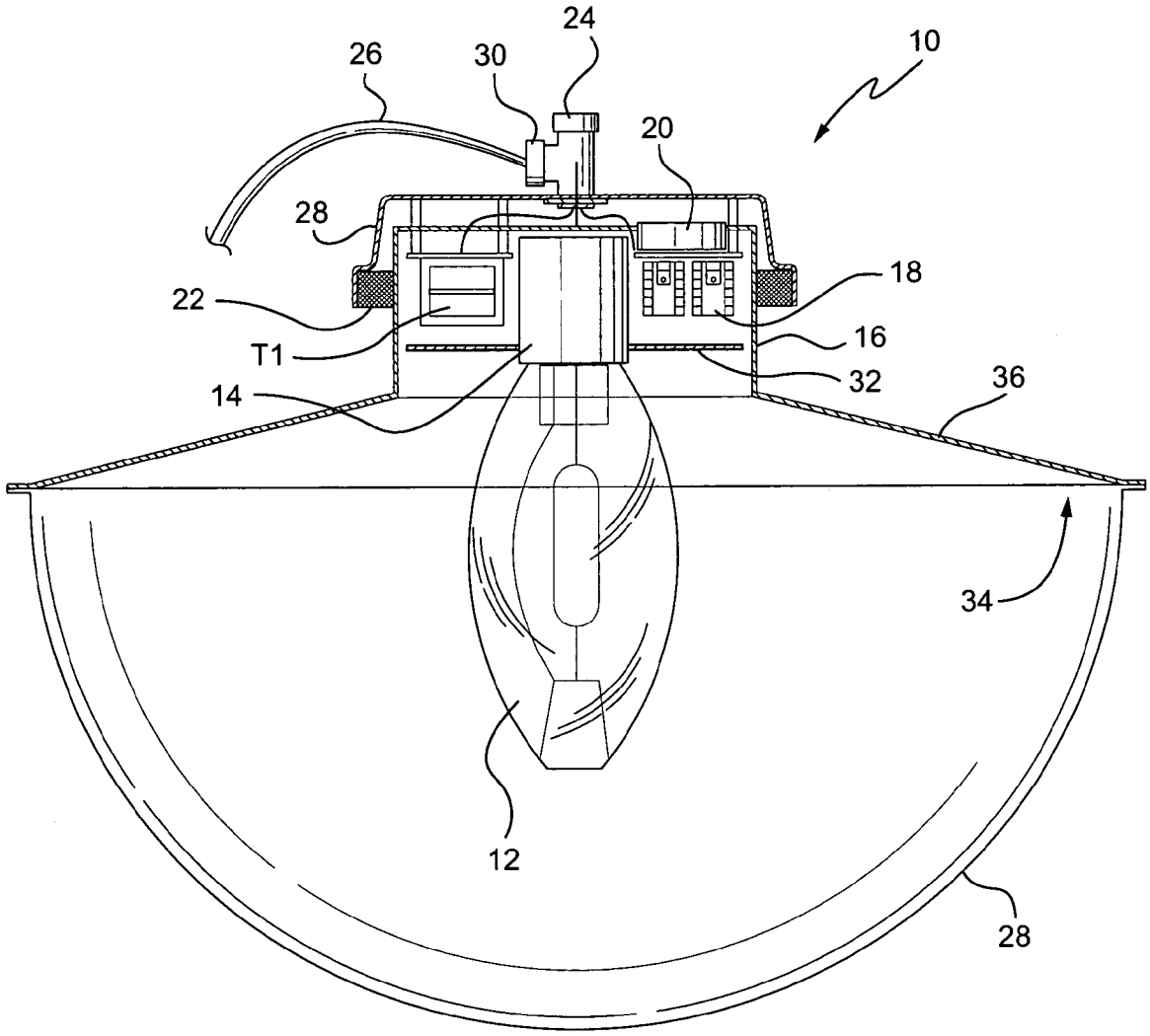
FIG. 1 is a side elevational view, in partial cross-section, of the mobile light of the present invention.

FIG. 1 is a side elevational view, in partial cross-section, of the mobile light 10 of the present invention. As can be seen from FIG. 1, mobile light 10 preferably uses a high-intensity discharge ("HID") lamp 12 that is a metal halide lamp. Preferably, lamp 12 is a 400 watt lamp capable of producing 42,000 lumens of light. Preferably, lamp 12 is manufactured with an internal coating that is designed to diffuse light. Lamps of this type are available from manufacturers, such as General Electric, Venture and Phillips.

In operation, lamp 12 is inserted into a mogul base 14 that is mounted within a housing 16 that includes a shade 36 that serves to reflect light emitted by lamp 12. Preferably, housing 16 is made from aluminum, although other suitable metals could be used. Surrounding and mounted on base 14 is a reflector ring 32 that serves to reflect light emitted by lamp 12.

Suspended from the bottom of housing 16 is a lens 28 that serves to shield lamp 12 from dust and other debris present in the work zone in which mobile light 10 is used. Preferably, lens 28 is made from a plastic acrylic in the form of a hemispherical globe, although other materials and shapes could be used to make lens 28. Lens 28 is mounted to housing 16 by a retaining ring 34 which engages both lens 28 and ring 30. Preferably, lens 28 is coated on the inside with a white paint that serves to evenly diffuse the light to eliminate glare and increase the effective intensity of the light produced by lamp 12 to thereby enhance the illumination provided by lamp 12. Alternatively, lens 28 could be coated on the outside. Preferably, the white paint is one manufactured by Valspar Paint under product code No. 165712 Gloss White, and available at Lowe's Home Improvement Centers. Preferably, the white paint is a gloss white enamel paint that is thinned with xylene to make it translucent. By diffusing the light provided by lamp 12 to eliminate glare, mobile light 10 of the present invention does not produce the kind of glare that motorists approaching a work zone and workers within the work zone typically experience with current work zone lighting.

Also mounted within housing 16 is a high frequency electronic driver board 18 that controls the ignition and operation of lamp 12, and cooling fans 20 which draw air into housing 16 to cool electronic driver board 18. The cooling air drawn into housing 16 by cooling fans 20 passes through a dust filter 22 that is preferably shaped like a ring so that it surrounds and engages housing 16. Filter 22 is preferably made from a polyester material. Mounted over housing 16 is top cap 28 shown in more detail in FIGS. 2 and 3. As can be seen in FIG. 1, top cap 28 engages dust filter 22 to produce a seal to protect lamp 12 and electronic driver board 18 within housing 16 from dust and other debris in the work zone in which mobile light 10 is used. The filtered air intake provided by dust filter 22 in combination with cooling fans 20 produces a positive pressure within lens 28 that tends to keep dust from entering lens 28 that would reduce the light output of lamp 12. For this purpose, cooling fan 20 pulls air into housing 16 through filter 22 to create the "positive pressure" within lens 28. The filtered air intake also serves to cool the internal components of lamp 10, such as electronic driver board 18 and lamp 12.

Mounted within and protruding from the top of top cap 28, is a conduit 24. Conduit 24 provides a weather tight fitting 30 through which electrical lead wires 26 enter top cap 28 and then housing 16 to be connected to cooling fans 20 and electronic driver board 18. Preferably, lead wires 26 are 25 feet in length to enable mobile light 10 to be connected to a 12V DC voltage source available from the battery and charging system of off-road construction vehicles, such as asphalt pavers, front end loaders, rollers, milling machines, etc. Of course, lead wires could be other suitable lengths different from 25 feet. Because mobile light 10 operates by using the DC power of a vehicle's battery and charging system, the need for an additional power source, such as a gasoline-powered generator, is eliminated.

Figure 2:
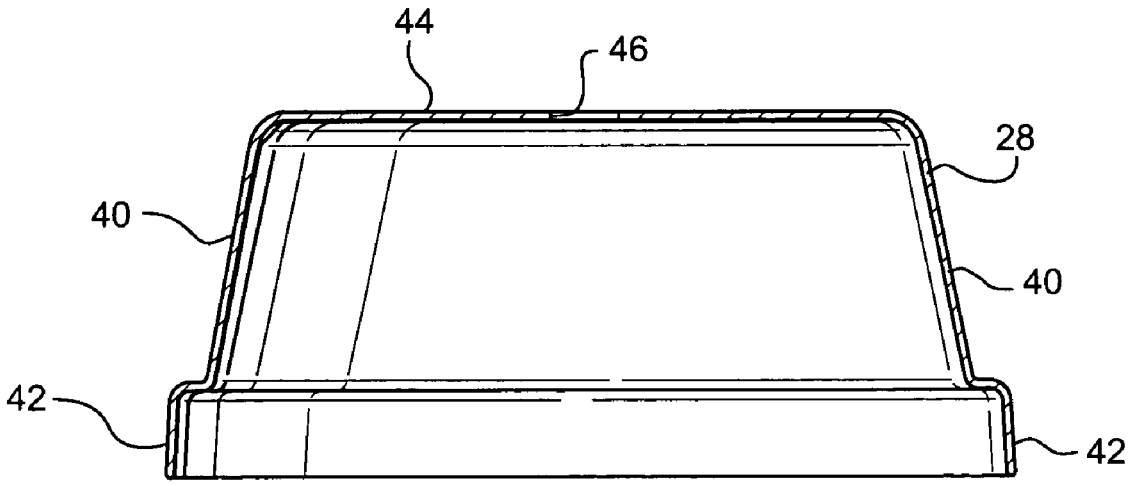
FIG. 2 is a cross-sectional view of a top cap for the mobile light of the present invention.
Figure 3:
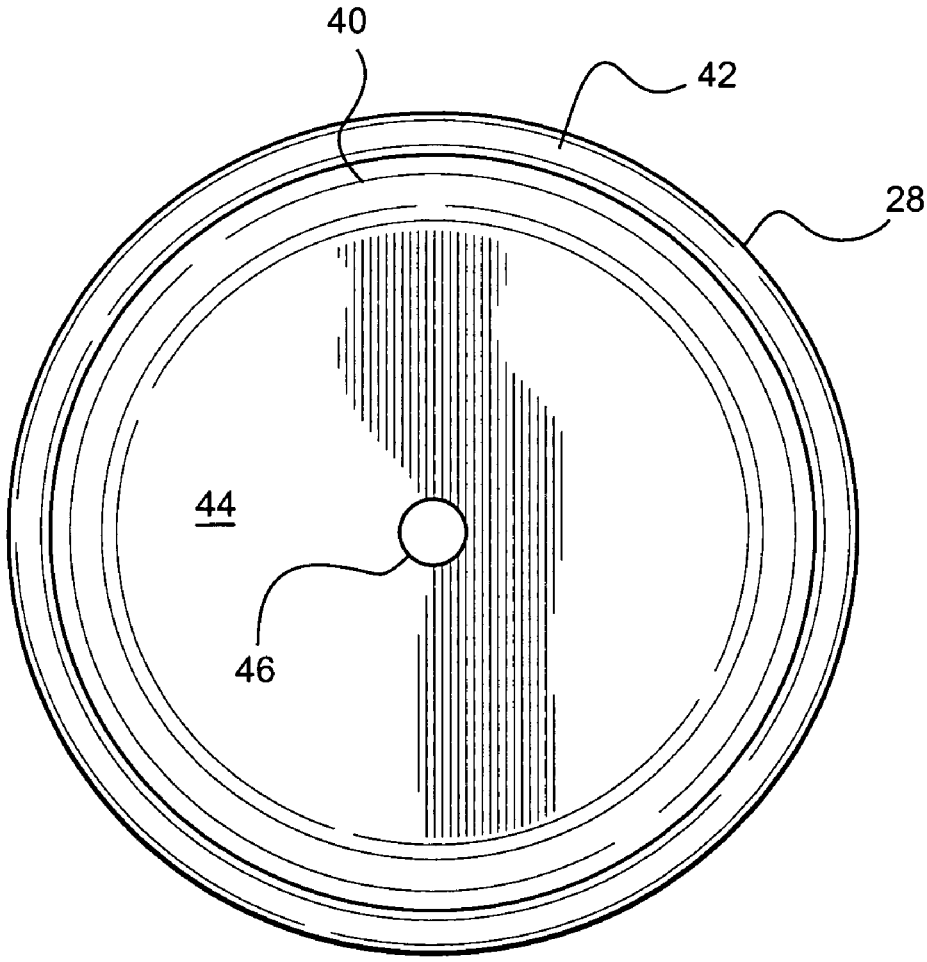
FIG. 3 is a plan view of a top cap for the mobile light of the present invention.

FIGS. 2 and 3 show a side elevational view, in cross-section, and a plan view, respectively, of top cap 28. Preferably, top cap 28 is substantially circular in shape, and has a side 40 that flares downwardly and outwardly from its top 44. On the top 44 of cap 28 is a hole 46 within which conduit 24 is mounted. At the base of flared side 40 is a flange 42 for easy installation of cap 28 over housing 16 and engagement of filter 22 surrounding housing 16. Upon installation, flange 42 engages dust filter 22 to seal housing 16 and lens 28 from dust and other debris in the work zone.

Figure 4:
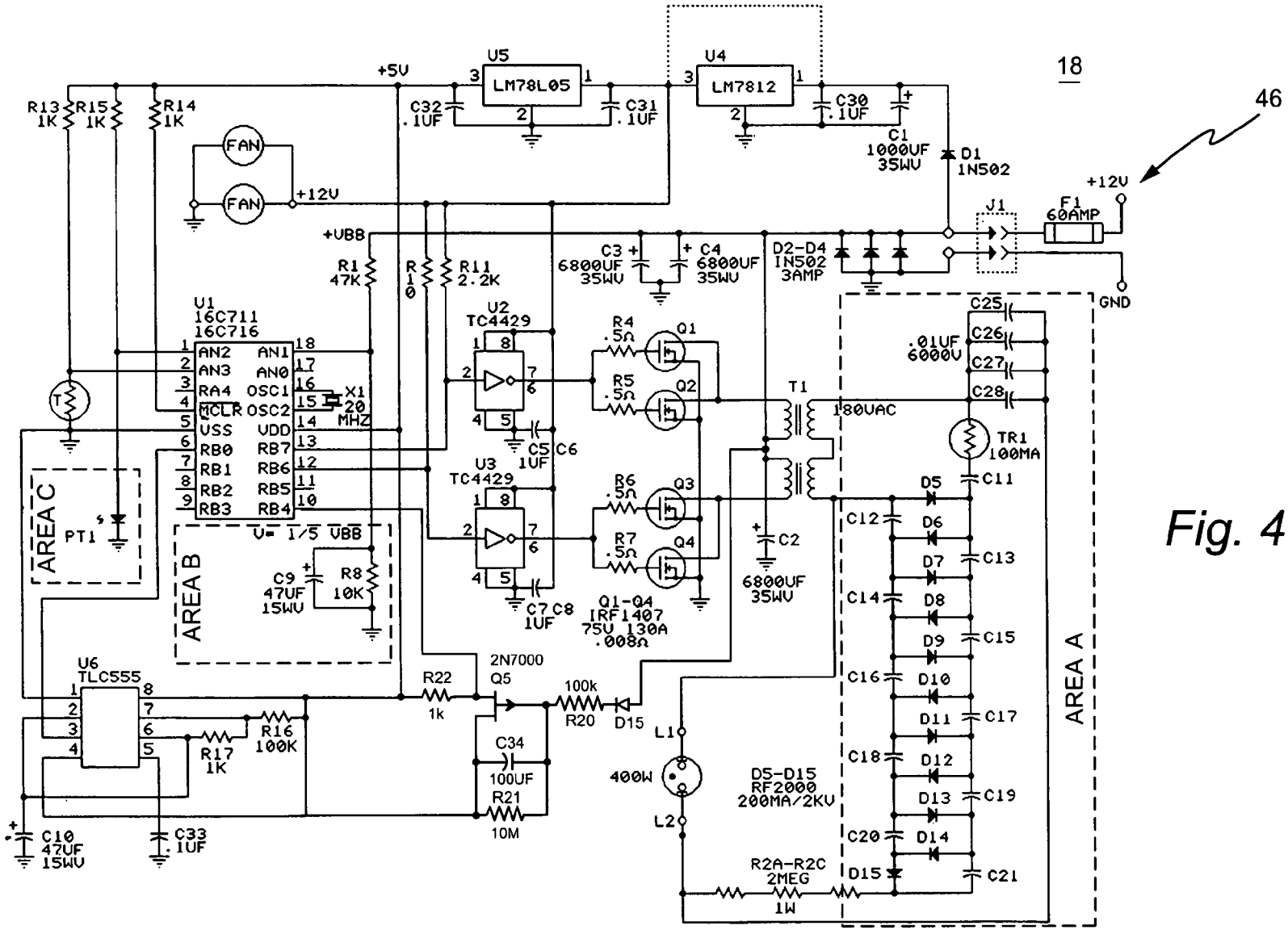
FIG. 4 is a schematic of the control circuit used to ignite and operate the mobile light of the present invention.

FIG. 4 shows a schematic of a high frequency electronic control circuit 46 mounted on driver board 18 that controls the operation of lamp 12, shown as a 400 W bulb connected to connectors L1 and L2 in the schematic of circuit 46. At the heart of circuit 46 is a microprocessor U1 that initiates the ignition and maintains the subsequent illumination of lamp 12. Preferably, microprocessor U1 is a 16C711 or 16C716 microprocessor manufactured by Microchip. Preferably, U1 includes both digital and analog inputs used to monitor various aspects of the operation of mobile light 10.

The input from a vehicle's battery is connected to circuit 46 through the terminals shown on the right side of circuit 46 feeding into a 60-amp fuse F1 and jumpers J1. Chip U5, which is an LM78L05, provides a regulated 5V DC for microprocessor U1. Chip U4, which is an LM7812, provides a regulated 12V DC to the cooling fans 20 when circuit 46 is connected to a 24V DC input that is found on some off-road equipment. Otherwise, when circuit 46 is connected to a 12V DC input that is more commonly found on off-road equipment, U4 is removed from circuit 46 by a jumper connected across U4. This jumper is shown as a dotted line connected across chip U4.

U1 monitors the input from the 12V DC voltage source through its input AN1, which is connected to a voltage divider circuit consisting of resistors R1 and R8, which drops the input voltage at AN1 to about one-fifth of the battery voltage. Connected in parallel to resistor R8 is a capacitor C9 (Area B), which eliminates ripple on the input voltage to input AN1.

When microprocessor U1 initially senses the presence of the 12V DC input voltage from a vehicle's battery, lamp 12 is not ignited. Approximately 10 seconds later, microprocessor U1 begins applying the 12V DC input voltage to the primary side of transformer T1 through FETs Q1/Q2 and alternately to Q3/Q4. A DC voltage multiplier circuit shown in Area A increases the peak AC voltage appearing on the secondary side of transformer T1 to initially ignite lamp 12. The voltage multiplier circuit can increase the peak AC voltage output of transformer T1 to a level of up to 5,000V to ignite the gas in HID lamp 12; however, more typically it increases it to a level of up to 3,000-4,000 V to ignite lamp 12. The voltage multiplier circuit shown in Area A is a rectifier circuit using diodes D5 to D15 and capacitors C12 to C21 to produce a DC output voltage that is a multiple of the peak voltage that appears on the secondary side of transformer T1. Transformer T1 is a step-up transformer that takes the switched 12V DC input and steps it up nominally to a 205 Vrms AC voltage. During ignition, lamp 12 does not require a lot of current, and thus the high voltage provided by the voltage multiplier circuit shown within area A of FIG. 4 is sufficient to ignite the gas within lamp 12 to begin illumination.

Circuit 46 also includes a delay circuit to prevent microprocessor U1 from initiating the ignition of lamp 12 where lamp 12 is still hot from just being on. This delay circuit is formed by FET Q5, resistors R20 to R22, capacitor C34 and diode D15. Initially, when circuit 46 turns on, microprocessor U1 senses the voltage across C34 through input RB4. If microprocessor U1 has been "sleeping" for only a couple of minutes, there will be a voltage across C34, and microprocessor U1 will wait 10 minutes before it initializes the ignition of lamp 12. Conversely, if microprocessor U1 has been "sleeping" for more than 15 minutes, there will be no voltage across C34, and microprocessor U1 will immediately begin the ignition of lamp 12.

Typically, the ignition of lamp 12 occurs in approximately 1 ms. Microprocessor U1 confirms the ignition and continued illumination of lamp 12 by sensing the current flowing through a photosensitive diode PT1 shown in Area C of the schematic of circuit 46. Photosensitive diode PT1 senses the light emitted by lamp 12 through a "peek hole" in reflector ring 32 that allows light to shine through onto photosensitive diode PT1, which is mounted on driver board 18. The current flowing through photosensitive diode PT1 will increase or decrease, respectively, as the illumination provided by lamp 12 increases or decreases. Microprocessor U1, in effect, senses the amount of current flowing through photosensitive diode PT1 by sensing the voltage at one of its analog inputs AN2. This voltage is a function of the drop across resistor R15, which will vary according to the amount of current flowing through such resistor. Depending on the amount of illumination sensed by microprocessor U1, it will vary the voltage applied to lamp 12.

Once lamp 12 is ignited, microprocessor U1 maintains the illumination of lamp 12. Microprocessor U1 does this by alternately switching field effect transistors (FETs) Q1/Q2 and Q3/Q4 at approximately 50 Khz to switch the 12V DC input at the primary side of transformer T1. Microprocessor U1 switches FETs Q1/Q2 and Q3/Q4 through FET drivers U2 and U3, which act as interfaces between the outputs RB7 and RB6 of microprocessor U1. Each of FET drivers U2 and U3 are preferably a TC 4429 chip. Microprocessor U1 continues the switching of FET pairs Q1/Q2 and Q3/Q4 through FET drivers, U2 and U3, respectively, to continue applying a switched DC signal to the primary side of step-up transformer T1. This, in turn, produces a quasi sine wave AC signal of preferably about 204 V rms on the secondary side of transformer T1, which is applied to lamp 12 to maintain its arc for continued illumination. This AC voltage is passed by capacitors C12 through C28 of the voltage multiplier circuit in Area A, which serve to block DC signals. The AC signal on the secondary side of transformer T1 can vary between 160V and 215V AC rms, depending on various conditions in light 10. For example, if microprocessor U1 senses that the 12V DC input to circuit 46 is changing, depending on the voltage it sees across the voltage divider R1 and R8, microprocessor U1 can compensate by varying the voltage applied to lamp 12. It does this by varying the frequency at which it switches FETs Q1/Q2 and Q3/Q4, whereby the impedance of capacitors C25 to C28 will vary with the change in frequency. The impedance of capacitors C25 to C28 will increase as the frequency decreases. This, in turn, reduces the voltage across lamp 12. Thus, for example, at 50 kHz, the impedance of capacitors C25 to C28 will increase enough to drop the voltage across lamp 12 substantially.

Microprocessor U1 ramps up the frequency at which it switches FETs Q1/Q2 and Q3/Q4 from an initial frequency of about 50 kHz to a high frequency of about 135 kHz, so as to effectively produce a constant current consumption by lamp 12 during its warm-up phase.

During the operation of work light 10, microprocessor U1 periodically receives an interrupt from an RC timing circuit formed by a TLC555 multivibrator circuit, designated as U6 in the schematic of circuit 46, and capacitors C10 and C33 and resistors R16 and R17 connected to U6. Every time microprocessor U1 receives an interrupt from chip U6 through its input RB0, which occurs about every 20 seconds, it performs one of several monitoring tasks. Microprocessor U1 receives interrupts from RC timing circuit U6 because of the extremely high demand for which microprocessor U1 is operating the FET drivers U2 and U3.

First, U1 determines whether the temperature in light 10 is too high. It does this by sensing at one of its analog inputs AN3 the voltage across a temperature thermistor T that is located near FETs Q1/Q2 and Q3/Q4 on board 18. Depending on the temperature sensed by microprocessor U1, it will vary the frequency at which it switches FETs Q1/Q2 and Q3/Q4 to diminish the output of lamp 12 to lower the temperature within mobile light 10. A rise in temperature can occur, for example, when filter 22 is clogged by dust or so as to prevent the cooling of circuit 46 by the air flow produced by cooling fan 20. It can also occur due to a failure of cooling fan 20.

When microprocessor U1 receives the next interrupt from RC timing circuit U6 twenty second later, it determines whether lamp 12 is still illuminated, and the amount of illumination it is providing. As explained above, microprocessor U1 confirms the continued illumination of lamp 12 and the amount of illumination provided by lamp 12 by sensing the current flowing through photosensitive diode PT1 shown in Area C of the schematic of circuit 46.

And when microprocessor U1 receives the next interrupt from RC timing circuit U6 twenty second after the second interrupt, it determines whether the voltage provided by the battery input to circuit 46 is too low or too high. Here again, as explained above, microprocessor U1 measures the voltage provided by the battery input to circuit 46 by sensing through its input AN1, the voltage across resistor R8 that is part of the voltage divider circuit formed by resistor R1 and resistor R8 and capacitor C9 in Area B of circuit 46's schematic.

Finally, as microprocessor U1 receives interrupts from RC timing circuit U6 every twenty seconds, the monitoring functions described above are repeated. It performs these monitoring functions by executing a program within its on-board memory that reflect measurements taken by its various analog inputs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A light that produces a high level of illumination without glare and that is capable of being powered by a DC voltage source, the light comprising:

a high-intensity discharge ("HID") lamp mounted within a housing, a lens mounted on the housing so as to enclose the lamp within the lens and housing, the lens being coated to diffuse light emitted from the lamp, a control circuit mounted within the housing and powered by the DC voltage, the control circuit comprising:

a switching circuit for switching the DC voltage to derive an AC voltage from the switched DC voltage, a voltage multiplier circuit for multiplying the AC voltage's peak voltage to a level capable of igniting the lamp, the voltage multiplier circuit being a rectifier circuit that produces a DC output voltage that is a multiple of the AC peak voltage and that is applied to the lamp to maintain illumination of the lamp once the lamp is ignited, a timing circuit for generating interrupts, and a microprocessor for initiating ignition of the lamp and for monitoring the temperature and illumination level of the light and the level of the DC voltage source in response to receiving the interrupts from the timing circuit and compensating for improper measurements of the light temperature and illumination and the DC voltage source level by varying the frequency at which it switches the switching circuit, and thus, the voltage applied to the lamp.

2. The light recited in claim 1, wherein the DC voltage is approximately 12V DC and the voltage multiplier circuit multiplies the peak AC voltage up to a level of approximately 5,000V to ignite a gas in the HID lamp.

3. The light recited in claim 1, wherein the DC voltage is approximately 12V DC and the voltage multiplier circuit multiplies the peak AC voltage up to a level of approximately 3,000V to 4,000V to ignite a gas in the HID lamp.

4. The light recited in claim 1, wherein the microprocessor controls the switching circuit.

5. The light recited in claim 4, wherein the switching circuit is comprised of a plurality of field effect transistors ("FETs") driven by the microprocessor so as to switch the DC voltage, and a step-up transformer including a primary to which the switched DC voltage is applied and a secondary for providing an AC signal that is applied to the lamp to maintain its illumination after ignition.

6. The light recited in claim 5, wherein the DC voltage is approximately 12V DC and the AC voltage is approximately 204V rms.

7. The light recited in claim 4, wherein the control circuit further comprises a voltage divider circuit whereby the microprocessor measures the voltage provided by the battery input to determine whether the input voltage is too low or too high.

8. The light recited in claim 4, wherein the control circuit further comprises a photosensitive circuit whereby the microprocessor determines whether the lamp is still illuminated and measures the amount of illumination the lamp is providing.

9. The light recited in claim 4, wherein the control circuit further comprises a temperature sensing circuit whereby the microprocessor determines whether the temperature in the light is too high.

10. The light recited in claim 1, wherein the interior of the lamp includes a coating that diffuses light.

11. The light recited in claim 1, wherein the lens is a hemispherical globe.

12. The light recited in claim 1, wherein the lens is made from an acrylic plastic.

13. The light recited in claim 1, wherein the DC voltage is approximately 24V DC, and the control circuit is further comprised of a regulator circuit providing a regulated voltage of approximately 12V DC.

14. The light recited in claim 1, wherein the lens is coated with a white paint to diffuse light emitted from the lamp.

15. The light recited in claim 1, wherein the lens is internally textured and coated with a translucent enamel white paint.

16. The light recited in claim 1, wherein the rectifier circuit includes a plurality of diodes and a plurality of capacitors.

17. The light recited in claim 1, wherein, when the microprocessor receives an interrupt, it determines whether the temperature in the light is too high by sensing the voltage across a temperature thermistor located near the switching circuit and changes the frequency at which it switches the switching circuitry to compensate for a temperature that is too high.

18. The light recited in claim 1, wherein, when the microprocessor receives an interrupt, it determines whether the lamp is still illuminated and, if so, the amount of illumination the lamp is providing, by sensing the current flowing through a photosensitive diode, and changes the frequency at which it switches the switching circuitry, and thus, the voltage applied to the lamp, to compensate for an illumination that is too low or too high.

19. The light recited in claim 1, wherein, when the microprocessor receives an interrupt, it determines whether the voltage provided by the DC voltage source is too low or too high by measuring the voltage across a resistor that is part of a voltage divider circuit, and changes the frequency at which it switches the switching circuitry, and thus, the voltage applied to the lamp, to compensate for a DC voltage source that is too low or too high.

20. The light recited in claim 19, wherein, when the microprocessor first senses the presence of the voltage provided by the DC voltage source, and determines that the lamp is not ignited by sensing a lack of current flowing through a photosensitive diode, after a predetermined delay, the microprocessor begins applying the voltage provided by the DC voltage source to the switching circuit to ignite the light.

21. The light recited in claim 20 further comprising a delay circuit to prevent the microprocessor from initiating ignition of the lamp where the lamp is hot and to allow the microprocessor to initiate ignition of the lamp where the lamp is not hot.

22. The light recited in claim 20, wherein the microprocessor is programmed to wait a predetermined period of time before it initializes the ignition of the lamp when the microprocessor senses a voltage that is still across a capacitor that is part of the delay circuit because the lamp has been off for a short period of time, and to immediately begin the ignition of the lamp when the microprocessor senses no voltage across the capacitor because the lamp has been off for a long period of time.

23. A light that produces a high level of illumination without glare and that is capable of being powered by a DC voltage source, the light comprising:

a high-intensity discharge ("HID") lamp mounted within a housing, a lens mounted on the housing so as to enclose the lamp within the lens and housing, the lens being coated to diffuse light emitted from the lamp, a control circuit mounted within the housing and powered by the DC voltage, the control circuit comprising:

a switching circuit for switching the DC voltage to derive an AC voltage from the switched DC voltage, and a voltage multiplier circuit for multiplying the AC voltage's peak value to a level capable of igniting the lamp, the multiplied AC peak value voltage being applied to the lamp to maintain illumination of the lamp once the lamp is ignited, wherein the control circuit further comprises a microprocessor for controlling the switching circuit, and wherein the microprocessor changes the frequency at which it switches the switching circuitry to control the AC voltage applied to the lamp, and thereby the illumination provided by the lamp, to compensate for improper measurements of temperature and illumination level of the light and the level of the DC voltage source that are monitored by the microprocessor in response to receiving interrupts from a timing circuit.

24. The light recited in claim 23, wherein the microprocessor ramps up the frequency at which it switches the switching circuitry from an initial frequency of about 50 kHz to a high frequency of about 135 kHz, whereby the microprocessor produces substantially a constant current consumption by the lamp during its warm-up phase.

25. A light that produces a high level of illumination without glare and that is capable of being powered by a DC voltage source, the light comprising:

a high-intensity discharge ("HID") lamp mounted within a housing, a lens mounted on the housing so as to enclose the lamp within the lens and housing, the lens being coated to diffuse light emitted from the lamp, a control circuit mounted within the housing and powered by the DC voltage, the control circuit comprising:

a switching circuit for switching the DC voltage to derive an AC voltage from the switched DC voltage, and a voltage multiplier circuit for multiplying the AC voltage's peak value to a level capable of igniting the lamp, the multiplied AC peak value voltage being applied to the lamp to maintain illumination of the lamp once the lamp is ignited, and a dust filter and at least one cooling fan, the dust filter and the at least one cooling fan in combination producing a positive pressure within the lens that tends to keep dust from entering the lens that would reduce the light output of the lamp.

26. A light that produces a high level of illumination without glare and that is capable of being powered by the DC voltage of a vehicle's battery and charging system, the light comprising:

a high-intensity discharge ("HID") lamp mounted within a housing, a lens mounted on the housing so as to enclose the lamp within the lens and housing, the lens being coated to diffuse light emitted from the lamp, a control circuit mounted within the housing and powered by the DC voltage, the control circuit comprising:

a switching circuit for deriving an AC voltage from the DC voltage, a voltage multiplier circuit for multiplying the AC voltage's peak voltage to a level capable of igniting the lamp, the voltage multiplier circuit being a rectifier circuit that produces a DC output voltage that is a multiple of the AC peak voltage, a timing circuit for generating interrupts, and a microprocessor for controlling the switching circuit to apply the peak AC voltage to the voltage multiplier circuit and to apply the AC voltage to the lamp to maintain illumination of the lamp once the lamp is ignited, the microprocessor monitoring the temperature and illumination level of the light and the level of the DC voltage source in response to receiving the interrupts from the timing circuit and compensating for improper measurements of the light temperature and illumination and the DC voltage source level by varying the frequency at which it switches the switching circuit, and thus, the voltage applied to the lamp.

27. A light that produces a high level of illumination without glare, the light comprising:

a high-intensity discharge ("HID") lamp mounted within a housing, a lens mounted on the housing so as to enclose the lamp within the lens and housing, the lens being coated with a translucent white paint to diffuse light emitted from the lamp, a dust filter mounted on the housing and at least one cooling fan mounted within the housing, the dust filter and the at least one cooling fan producing a positive pressure within the housing and lens that tends to keep dust from entering the housing and lens, a control circuit mounted within the housing and powered by DC voltage from a vehicle's battery and charging system, the control circuit comprising:

a switching circuit for switching the DC voltage to derive an AC voltage from the DC voltage that is applied to the lamp to maintain illumination of the lamp once the lamp is ignited, a voltage multiplier circuit for multiplying a peak value of the switched DC voltage to a voltage level capable of igniting the lamp, and a microprocessor for controlling the switching circuit, the microprocessor controlling the frequency at which it switches the switching circuitry to control the AC voltage applied to the lamp, and thereby the illumination provided by the lamp, a voltage divider circuit whereby the microprocessor determines whether the input voltage is too low or too high, a photosensitive circuit whereby the microprocessor determines the amount of illumination the lamp is providing, and a temperature sensing circuit whereby the microprocessor determines whether the temperature in the light is too high.

* * * * *